United States Patent [19]

Ganz

[11] Patent Number: 5,005,218

[45] Date of Patent: Apr. 9, 1991

[54] GARMENT

[75] Inventor: Daniel Ganz, Rockville Center, N.Y.

[73] Assignee: Ganz Manufacturing Co., Inc., Rockville Centre, N.Y.

[21] Appl. No.: 417,508

[22] Filed: Oct. 5, 1989

[51] Int. Cl.[5] ..... A41B 1/00; A41B 1/02; A41B 1/08; A41D 27/08

[52] U.S. Cl. ..... 2/69; 2/106; 2/113; 2/115; 2/244; 446/28

[58] Field of Search ..... 2/46, 49 R, 51, 69, 2/69.5, 74, 75, 80, 90, 105, 106, 113, 114, 115, 244; 446/26, 28

[56] References Cited

U.S. PATENT DOCUMENTS

| | | | |
|---|---|---|---|
| 528,988 | 11/1894 | Rubens | 2/113 |
| 1,172,996 | 2/1916 | Hynard | 2/105 |
| 1,252,750 | 1/1918 | Warshaver | 2/113 X |
| 1,497,685 | 6/1924 | Hoyme | 2/114 |
| 1,849,578 | 3/1932 | Jackson | 2/74 |
| 2,079,656 | 5/1937 | Mursky | 2/105 X |
| 2,470,678 | 5/1949 | Auslender | 2/105 |
| 3,484,974 | 12/1969 | Culmone | 40/129 |
| 4,249,268 | 2/1981 | Berler | 2/115 |
| 4,710,979 | 12/1987 | Bull et al. | 2/49 R |
| 4,723,323 | 2/1988 | Wright, Jr. | 2/49 R |
| 4,829,601 | 5/1989 | Spanier | 2/49 R |

*Primary Examiner*—Werner H. Schroeder
*Assistant Examiner*—Jeanette E. Chapman
*Attorney, Agent, or Firm*—Morrison Law Firm

[57] ABSTRACT

An aperture in a body of a garment co-acts with a part of the garment to produce a combination of a two-dimensional image or design appearing on the garment with a three-dimensional part of the garment. The part of the garment capable of being drawn through the aperture forms a member which is a part of the two-dimensional design appearing on the garment. The part of the garment that is drawn through the aperture tends to cinch the waist of the garment about the user. An optional fastener keeps the drawn-through part of the garment from withdrawing through the aperture.

19 Claims, 4 Drawing Sheets

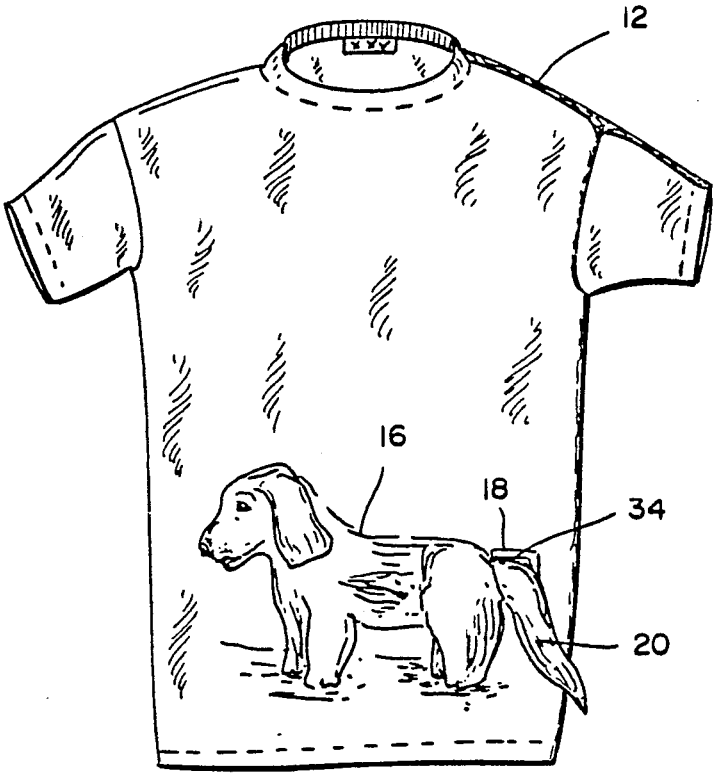
FIG. 10
FIG. 11
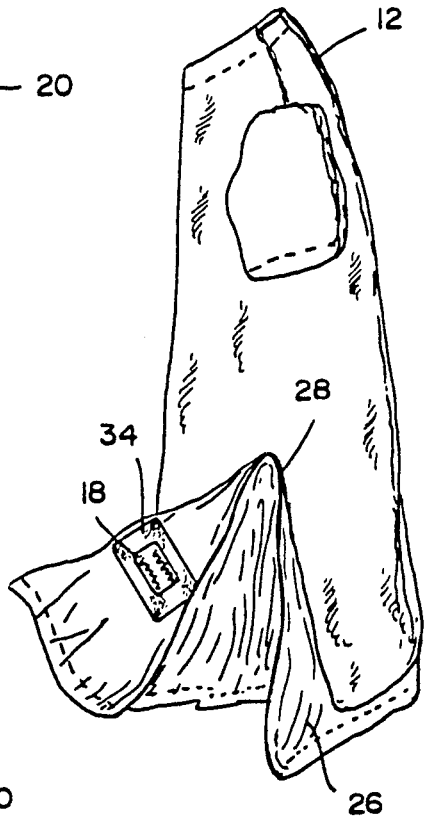
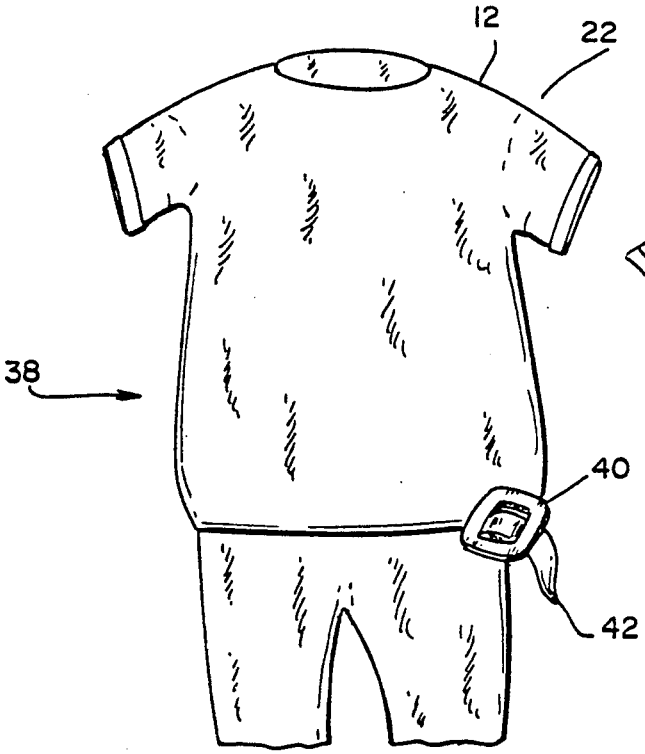
FIG. 12

GARMENT

BACKGROUND OF THE INVENTION

The present invention relates to clothing and particularly to shirts and, more particularly, to techniques for tightening the waist of a shirt or T-shirt about the waist of a wearer.

It is often desirable to tighten the waist of a T-shirt about the waist of a wearer. Prior to the present invention, wearers employed a sash or belt over the T-shirt to cinch it's waist about them.

An undershirt disclosed in U.S. Pat. No. 528,988 utilizes bands to fasten an undershirt around an infant's body. Such a shirt does not require the fastening of buttons and thus makes the task of fastening the shirt on the infant's body much easier.

U.S. Pat. No. 1,030,989 discloses another infant's garment that utilizes a pinning flap to fasten the garment by holding it when inserted in a horizontal slit. The slit is on one of the wide side flaps which overlaps a second flap.

U.S. Pat. No. 4,466,136 describes a composite T-shirt. It has an imprinted picture of a guitar, and a removable portion which is a guitar's neck. The guitar neck is a totally separate member which is fastened to the T-shirt with a Velcro fastener.

U.S. Pat. No. Des. 253,497 shows a ornamental design for a skirt. It has an applique having a shape of a shoe, and a simulated shoelace painted on the skirt.

U.S. Pat. No. 4,365,353 shows a body puppet made of a garment, like a T-shirt, which has a picture of a human face. The garment is formed from a resilient material which can be stretched. When stretched, the human face depicted on the garment assumes different expressions.

The prior art appears innocent of any teaching of a garment having an integral means for cinching the waist and in which the waist cinching means forms a three-dimensional part of a two-dimensional design appearing on the garment.

OBJECTS AND SUMMARY OF THE INVENTION

Accordingly, it is an object of the invention to provide a garment in which a part of the garment is also a three-dimensional part of a two-dimensional design appearing on the garment.

It is a further object of the invention to provide a garment which has an aperture co-acting with a part of the garment to produce a combination of a two-dimensional image appearing on the garment with a three-dimensional part of the garment.

It is a still further object of the invention to provide a T-shirt which has an aperture capable of co-acting with a part of the T-shirt to form a combination of the part of the T-shirt with the remainder of the T-shirt.

It is a still further object of the invention to provide a T-shirt having a two-dimensional design combined with a three-dimensional piece which is also a part of that design.

It is a still further object of the invention to provide a shirt having an integral means for cinching at the waist of the wearer.

It is a still further object of the invention to provide a shirt having an opening in the region of the waist and a portion of the waist capable of being pulled through the opening to reduce a diameter of the waist, whereby the waist of the garment is cinched about the waist of the wearer.

Briefly stated, the present invention provides a garment having an aperture in a body thereof which co-acts with a part of the garment to produce a combination of a two-dimensional image or design appearing on the garment with a three-dimensional part of the garment. The part of the garment capable of being drawn through the aperture forms a member which is a part of the two-dimensional design appearing on the garment. The part of the garment that is drawn through the aperture tends to cinch the waist of the garment about the user. An optional fastener keeps the drawn-through part of the garment from withdrawing through the aperture.

According to an embodiment of the invention, there is provided a garment comprising: a body, the body including a front part and a back part, the body having an outer surface, the surface having at least one aperture, the body having a first part, the first part being capable of being drawn through the aperture.

According to a feature of the invention, there is provided a T-shirt comprising: a body, the body having an outer surface, the surface having at least one aperture, the body having a first part formed by cutting the body substantially along it's longitudinal axis, the surface further including a two-dimensional design, wherein the first part is capable of being drawn through the at least one aperture forming a three-dimensional member which also forms a three-dimensional part of the two-dimensional design so that a combined two-dimensional—three-dimensional composite design is formed when the first part is drawn through the aperture.

According to a further feature of the invention, there is provided a shirt comprising: an aperture, means for permitting a portion of the shirt to be passed through the aperture, whereby the shirt is cinched about a user, a fastener, the fastener including a slot therein, the slot permitting passage therethrough of the portion external to the shirt, and the fastener being of a material, and the slot being of a size to provide substantial friction with the portion passing therethrough, whereby the fastener tends to resist releasing the portion.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 10 is a front view of a garment according to an embodiment of the present invention.

FIG. 11 is a side view of a garment according to an embodiment of the present invention.

FIG. 12 is a front view of a garment according to an embodiment of the present invention.

DETAILED DESCRIPTION OF THE PREFERRED EMBODIMENTS

Figure 1:
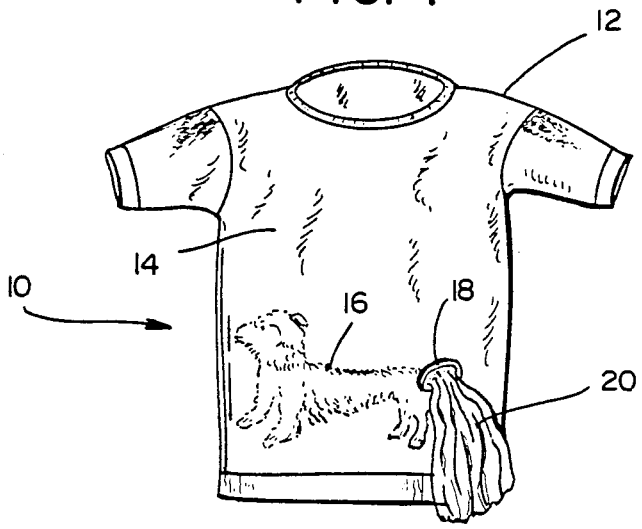
FIG. 1 is a front view of a garment according to an embodiment of the present invention.

Referring to FIG. 1, there is shown, generally at 10, a front view of a garment according to an embodiment of the present invention. A body 12 includes a front part 14 having thereon a two-dimensional design 16 which, in this case, is a picture of a dog. An aperture 18 is located at the place where the dog's tail would normally appear. A three-dimensional design 20 is drawn through aperture 18. In the present case three-dimensional design 20 depicts a tail of the dog in two-dimensional design 16. This combination of a two-dimensional design with a three-dimensional design produces an original combined two-dimensional—three-dimensional design of the dog which is very attractive. As will be detailed hereinafter, three-dimensional design 20 is formed of a portion of a waistband of garment 10. As three-dimensional design 20 is drawn through aperture 18, the waistband is tightened or cinched about the waist of the wearer.

Figure 2:
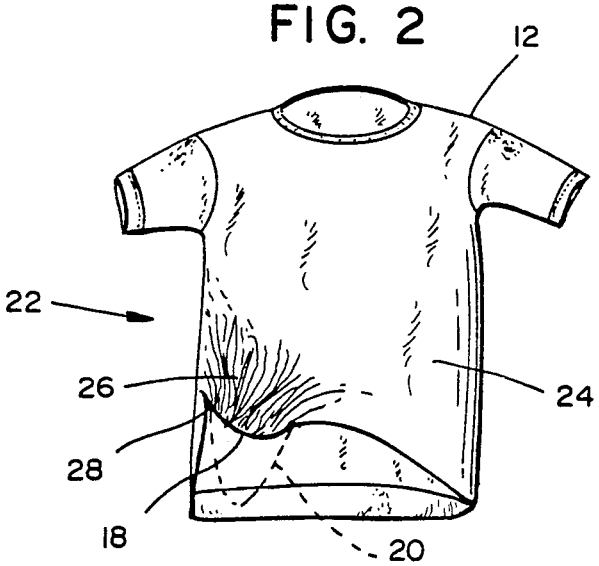
FIG. 2 is a back view of a garment according to an embodiment of the present invention.

FIG. 2 shows, generally at 22, a back view of a garment according to an embodiment of the present invention. A cut 28 in a back part 24 of body 12 frees a part 26 of the garment 22 sufficiently to permit it to be drawn through aperture 18. This tightens the waist of garment 22. In addition, part 26 preferably includes a design thereon that complements the two-dimensional design 16 (FIG. 1), whereby part 26 forms three-dimensional design 20 when it is pulled through aperture 18.

It would be clear to one skilled in the art that the two-dimensional design may appear on back part 24 instead of front part 14. In that case, aperture 18 also appears on back part 24.

Figure 3:
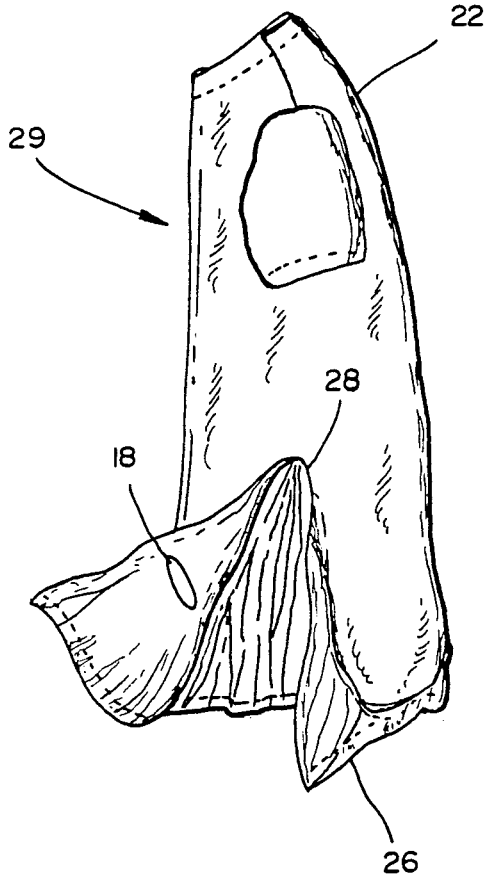
FIG. 3 is a side view of a garment according to an embodiment of the present invention.

FIG. 3 shows, generarlly at 29, a side view of a garment according to an embodiment of the present invention. A cut 28 on the side of body 12 frees part 26 of garment 22, which can be pulled through aperture 18 located either in the front or in the back of garment 22. Part 26 may include a design complementing a two-dimensional design, e.g., the design shown in FIG. 1.

Figure 4:
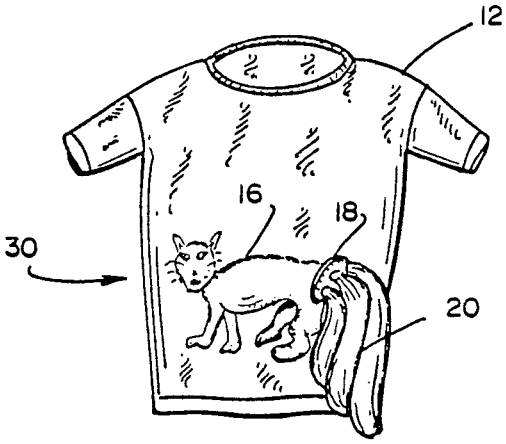
FIG. 4 is a front view of a garment according to an embodiment of the present invention.

FIG. 4 shows, generally at 30, a front view of a garment according to an embodiment of the present invention. Instead of the design of a dog, two-dimensional design 16 depicts a cat. Similarly with the embodiment of FIG. 1, the cat's tail is formed by three-dimensional design 20 which is formed by drawing part 26 through aperture 18.

Figure 5:
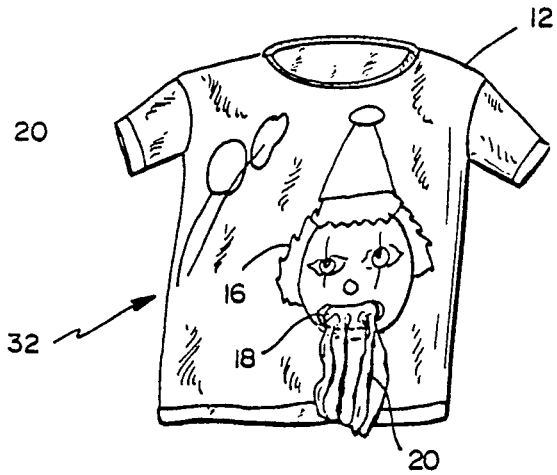
FIG. 5 is a front view of a garment according to an embodiment of the present invention.

FIG. 5 shows, generally at 32, a front view of a garment according to an embodiment of the present invention. Here, two-dimensional design 16 is a picture of a clown. Aperture 18 is the clowns mouth, and three-dimensional design 20 is the clown's tongue.

Aperture 18 may be formed not only by cutting body 12 of garment 10, but also may be an aperture formed in a member attached to body 12 with any suitable means known in the art, for instance, sewing it to body 12, attaching it to body 12 with an adhesive, or using a Velcro fasteners.

If the garment is cut, the cut 28 may be made in any convenient place. In the case where the two-dimensional design is placed on the front part of the garment, the cut is usually made on the back part or on the side of the body of the garment.

The illustrative design elements selected for two-dimensional design 16 and three-dimensional design 20 should not be considered to limit the scope of the invention.

Figure 7:
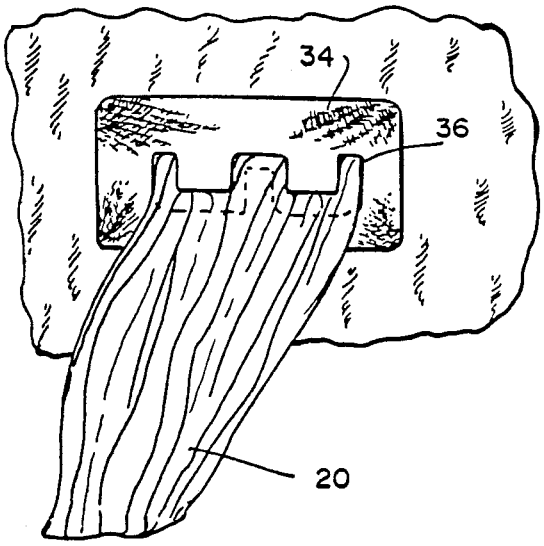
FIG. 7 is a front view of a fastener according to an embodiment of the present invention.
Figure 6:
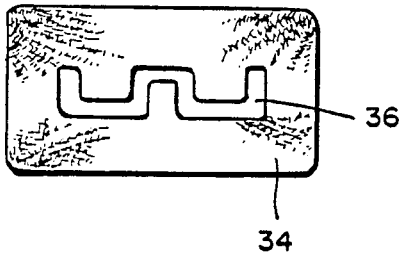
FIG. 6 is a front view of a fastener according to an embodiment of the present invention.
Figure 8:
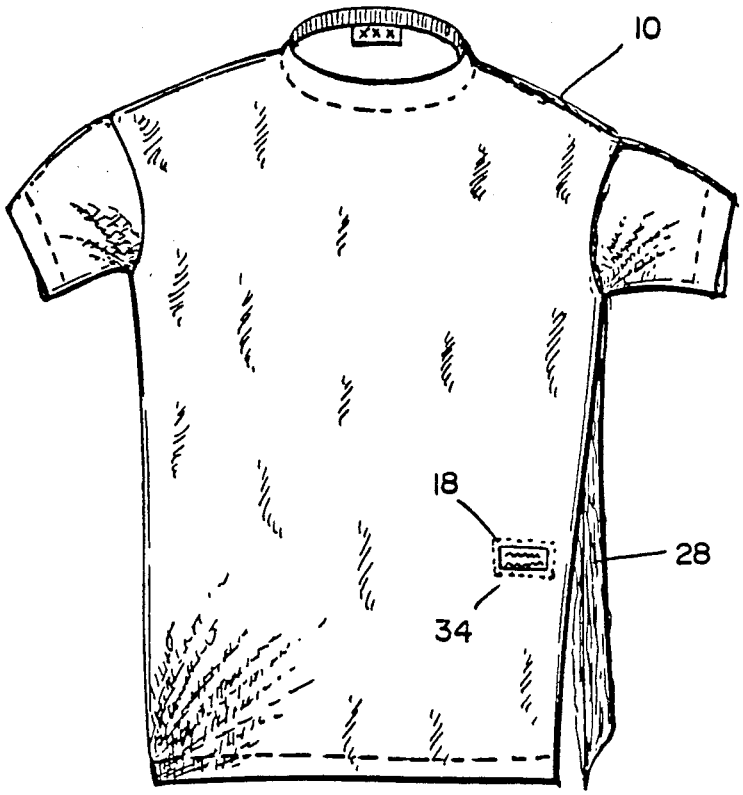
FIG. 8 is a front view of a garment according to an embodiment of the present invention.
Figure 9:
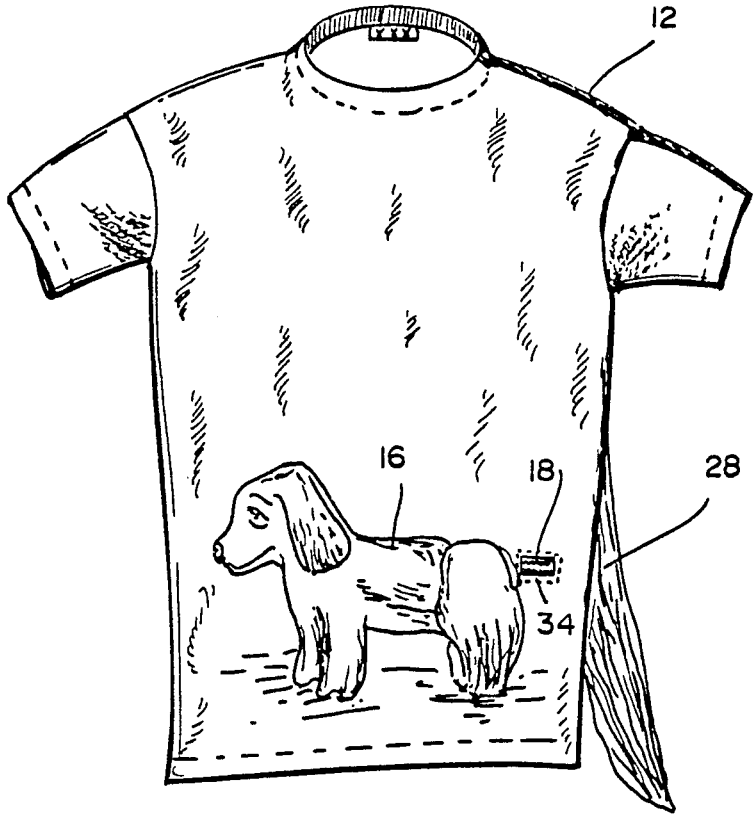
FIG. 9 is a front view of a garment according to an embodiment of the present invention.

Referring now to FIGS. 6 and 7, there is shown a fastener or or holder 34 adapted for holding three-dimensional design 20 against withdrawal back through aperture 18. A slot 36 in fastener 34 permits feeding three-dimensional design 20 therethrough. Fastener 34 preferably of a flexible material such as, for example, plastic or paperboard. This permits slot 36 to deform to accommodate the passage of three-dimensional design 20 therethrough. When deformed in this way, substantial friction is developed between slot 36 and three-dimensional design 20, whereby holding of design 20 is accomplished at a selected position or in other words, back feed withdrawal of three-dimensional design 20 is resisted. Fastener 34 is most preferably of a transparent material so that, when installed, a portion of two-dimensional design 16 covered thereby remains visible.

Fastener 34 may be a separate element that is slipped onto three-dimensional design 20. Alternatively, fastener 34 may be affixed outside or inside garment 10.

Slot 36 may be formed in any convenient shape such as, for example, the serpentine shape shown, a circle, a straight line, a sawtooth or one or more curves or arcs.

It should also be clear to one skilled in the art that some garments do not require cut 28 to permit slack material for inserting through aperture 18. Instead, a waistband of the garment may be simply grasped and pulled through aperture 18. Also, more than one effect can be created by including two or more different three-dimensional designs on different portions of the waistband of garment 10. Thus, a wearer may express an idea according to which garment 30 is combined with two-dimensional design 16. Similarly, more than one aperture 18 may be provided for use with one or more three-dimensional designs 20. The selection of a particular aperture 18 may be used to express an idea of the wearer.

FIGS. 8–11 show embodiments of the invention utilizing fastener 34.

FIG. 12 shows, generally at 38, an embodiment of the present invention. Fastener 40 serves to hold flap 42. Both fastener 40 and flap 42 serve to tighten garment 22 around the hip. Fastener 40 can be placed in the front, in the back, or on the side of garment 22. Garment 22 can be tightened around the hip or around the waist. Flap 42 is formed by cutting garment 22 as shown in FIGS. 2–3. In the above embodiment, flap 42 may not be part of a two-dimensional design, and its function is to be an instrument in the tightening of garment 22 around the hip or around the waist. However, a design can be placed on either part of garment 22 and flap 42.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A garment comprising:

a body having a front part and a back part;

said body having an outer surface;

said surface having at least one aperture;

said body having a first part, said first part being capable of being drawn through said aperture. said front part including a two-dimensional design, and said first part being capable of being drawn through said aperture forming a three-dimensional member which also forms a three-dimensional part of said two-dimensional design so a combined two-dimensional—three-dimensional composite design is formed when said first part is drawn through said aperture.

2. The garment of claim 1, wherein said body is provided with a cut to produce a free portion of the body adjacent the cut and constituting the body first part which can be drawn through said aperture.

3. The garment of claim 2, wherein said body is cut at its back part, and said aperture is situated on said front part of said body.

4. The garment of claim 1, wherein said garment is a T-shirt, and said two-dimensional design is a picture of an animal.

5. The garment of claim 1, wherein said two-dimensional design is a picture of a dog, and said first part is a dog's tail.

6. The garment of claim 1, wherein said two-dimensional design is a picture of a cat, and said first part is a cat's tail.

7. The garment of claim 1, wherein said garment is a T-shirt, and said two-dimensional design is a picture of a clown, and said first part is a clown's tongue.

8. The garment of claim 1, wherein said garment is a T-shirt, and said two-dimensional design is a picture of an animal.

9. The garment of claim 8, wherein said two-dimensional design is a picture of a dog, and said first part is a dog's tail.

10. The garment of claim 8, wherein said two-dimensional design is a picture of a cat, and said first part is a cat's tail.

11. The garment of claim 8, wherein said garment is a T-shirt, and said two-dimensional design is a picture of a clown, and said first part is a clown's tongue.

12. A T-shirt comprising:

a body;

said body having an outer surface;

said surface having at least one aperture;

said body having a first part formed by cutting said body substantially along it's longitudinal axis;

said surface further including a two-dimensional design, wherein said first part is capable of being drawn through said at least one aperture forming a three-dimensional member which also forms a three-dimensional part of said two-dimensional design so a combined two-dimensional—three-dimensional composite design is formed when said first part is drawn through said aperture.

13. The T-shirt of claim 12, wherein said body also has a front and a back sides, and wherein said two-dimensional design is situated on said front side.

14. A shirt comprising:

means defining an aperture;

said shirt including a portion which can be passed through said aperture, whereby said shirt can be tightened to cinched condition about a user;

a holder having a slot therein, said holder being of a flexible material, the portion of the shirt passed through said aperture being feedable through said slot; and said slot being of a size to provide substantial friction with the shirt portion fed therethrough, whereby said holder resists withdrawal of said portion therefrom thereby maintaining said shirt in cinched condition.

15. A shirt according to claim 14, wherein said slot is a serpentine slot.

16. A shirt according to claim 14, wherein said holder is substantially transparent, whereby a portion of said shirt covered by said holder remains visible through said fastener.

17. A shirt according to claim 14, wherein said holder is transparent plastic.

18. A shirt according to claim 14, wherein said holder is a paper material.

19. The shirt according to claim 14, wherein said aperture is located in a lower part of said shirt, and said shirt is cinched around a hip area of said person.

* * * * *